United States Patent [19]

Waluk

[11] Patent Number: 5,048,883

[45] Date of Patent: Sep. 17, 1991

[54] SNOW SHOVEL/SCRAPER

[75] Inventor: James P. Waluk, Winnipeg, Canada

[73] Assignee: Debra Waluk, Manitoba, Canada

[21] Appl. No.: 510,663

[22] Filed: Apr. 18, 1990

[30] Foreign Application Priority Data

Apr. 18, 1989 [CA] Canada ..... 597055

[51] Int. Cl.[5] ..... E01H 5/02

[52] U.S. Cl. ..... 294/54.005; 294/57; 294/58; 37/265; 37/285

[58] Field of Search ..... 295/54.5, 51, 57, 58; 135/66, 69, 75; 37/265, 130, 283, 285, 271, 278, 284; 172/351, 353, 370

[56] References Cited

U.S. PATENT DOCUMENTS

| | | | |
|---|---|---|---|
| 187,222 | 2/1877 | Dowler | 172/353 |
| 607,154 | 7/1898 | Berck | 294/58 |
| 1,009,824 | 11/1911 | Birdsong | 172/353 |
| 1,015,969 | 1/1912 | McCrary | 37/130 |
| 1,285,046 | 11/1918 | Clemetson | 37/130 |
| 1,629,915 | 5/1927 | Hampson | 172/353 |
| 1,693,472 | 11/1928 | Batty | 294/54.005 |
| 2,614,879 | 10/1952 | Citso | 294/58 |
| 2,846,785 | 8/1958 | Underwood | 294/54.5 |
| 3,136,574 | 6/1964 | Pasquale | 294/54.5 |
| 3,643,356 | 2/1972 | Gohl | 37/265 |
| 3,768,495 | 10/1973 | Smith | 135/69 |
| 4,224,751 | 9/1980 | Schoemann et al. | 37/265 |
| 4,265,475 | 5/1981 | Jarvis | 37/273 |
| 4,559,726 | 12/1985 | Moisan | 294/54.5 |
| 4,669,206 | 6/1987 | Yost | 294/54.5 |
| 4,721,125 | 1/1988 | Wang-Lee | 135/69 |
| 4,878,704 | 11/1989 | Jacanin, Jr. et al. | 294/51 |
| 4,910,893 | 3/1990 | Asay | 294/54.5 |

FOREIGN PATENT DOCUMENTS

| | | | |
|---|---|---|---|
| 0568193 | 8/1960 | Belgium | 37/130 |
| 618350 | 4/1961 | Canada . | |
| 0925571 | 9/1947 | France | 172/353 |
| 1311976 | 1/1962 | France | 294/54.5 |
| 0782336 | 9/1959 | United Kingdom | 37/130 |

*Primary Examiner*—Johnny D. Cherry
*Assistant Examiner*—Cathleen Pringle
*Attorney, Agent, or Firm*—Adrian D. Battison; Stanley G. Ade; Murray E. Thrift

[57] ABSTRACT

A snow shovel/scraper comprises a blade in form of a flat sheet of metal which has three transverse bend lines defining a base panel, a narrow scraping edge along the forward edge of the base panel, and a pair of receptacle panels which extend upwardly from the rear edge of the base panel for carrying the snow forwardly. The blade is attached to a handle arrangement in the form of a pair of rails which are adjustable in length. The upper end of each rail includes a shoulder engaging portion having a curved projection at right angles to the rail and at right angles to the scraping edge to fit into the underarm area of the user. In between the upper end and the blade is mounted a crossbar which can be adjusted along the length of the rails and to space the rails at a required spacing. The crossbar has a pair of handles turned downwardly from the rails at either side of the rails for grasping by the hands of the user with the shoulders under the upper curved portions. The handle arrangement allows the blade to be pushed using the shoulders and hands of the user in a vigorous pushing action requiring little muscular effort.

4 Claims, 2 Drawing Sheets

SNOW SHOVEL/SCRAPER

BACKGROUND OF THE INVENTION

This invention relates to a snow shovel/scraper which can be pushed manually by a user so as to scrape snow from a ground surface and to push that snow to one side of the surface.

Various devices are available for shoveling or moving snow on a manual basis.

Conventional snow shovels are available which include an elongated handle generally with a T-piece at the end of the handle and a wide shovel blade at the other end which can be used to push the snow or to lift the snow for throwing. The pushing action is however limited to that which can be obtained by hand force or by pressing the T-bar piece of the handle against the lower part of the body of the user. This limits the amount of snow that can be pushed.

Other designs of scoop arrangement are available for scraping snow into a scoop and then pulling or transporting the snow for dumping.

These designs however are generally unsatisfactory in that they are not properly designed for application of force by the user for moving of the snow. This either limits the amount of snow which can be moved or makes it physically challenging for the user.

SUMMARY OF THE INVENTION

It is one object of the present invention, therefore, to provide a device for moving snow which is operated strictly by manual force and which is designed to enable the user to apply force in an improved manner.

According to the invention, therefore, there is provided a snow shovel comprising a blade including a blade edge arranged to scrape the ground and a blade surface to push snow lifted by the edge, and a handle arrangement by which the blade can be pushed across the ground, the handle arrangement comprising a pair of shoulder receiving portions each defining a receptacle area which extends substantially at right angles to the blade edge with the portions being spaced in a direction longitudinally of the edge each for engaging an area on the user adjacent the shoulder and arm, a pair of hand grip members, and frame means mounting the shoulder receiving portions on the blade such that the shoulder receiving portions are spaced from the blade by a distance such that the shoulder receiving portions lie substantially at shoulder height with the blade edge on the ground and means mounting the hand grip members between the shoulder receiving portions and the blade.

The device therefore enables the user to place his or her shoulders against the device to significantly increase the amount of force which is applied while reducing the necessity for vigorous muscular activity. The user can thus push with the shoulder area and with the hands so the device is controlled in its scraping action and the weight of the user can be applied in the pushing action. This enables more snow to be pushed and enables the possibility of an increased blade width to accommodate the greater amount of snow which can be pushed.

The device can be adjusted so that the width of the shoulder portions is moved inwardly and outwardly to accommodate different sizes of user. In addition the length of the rails connecting the shoulder portions to the blade can be increased and decreased to accommodate different heights of the user. The position of the hand grip members can also be adjusted simply in a direction longitudinal of the side rails.

With the foregoing in view, and other advantages as will become apparent to those skilled in the art to which this invention relates as this specification proceeds, the invention is herein described by reference to the accompanying drawings forming a part hereof, which includes a description of the best mode known to the applicant and of the preferred typical embodiment of the principles of the present invention, in which:

DESCRIPTION OF THE DRAWINGS

In the drawings like characters of reference indicate corresponding parts in the different figures.

DETAILED DESCRIPTION

Figure 1:
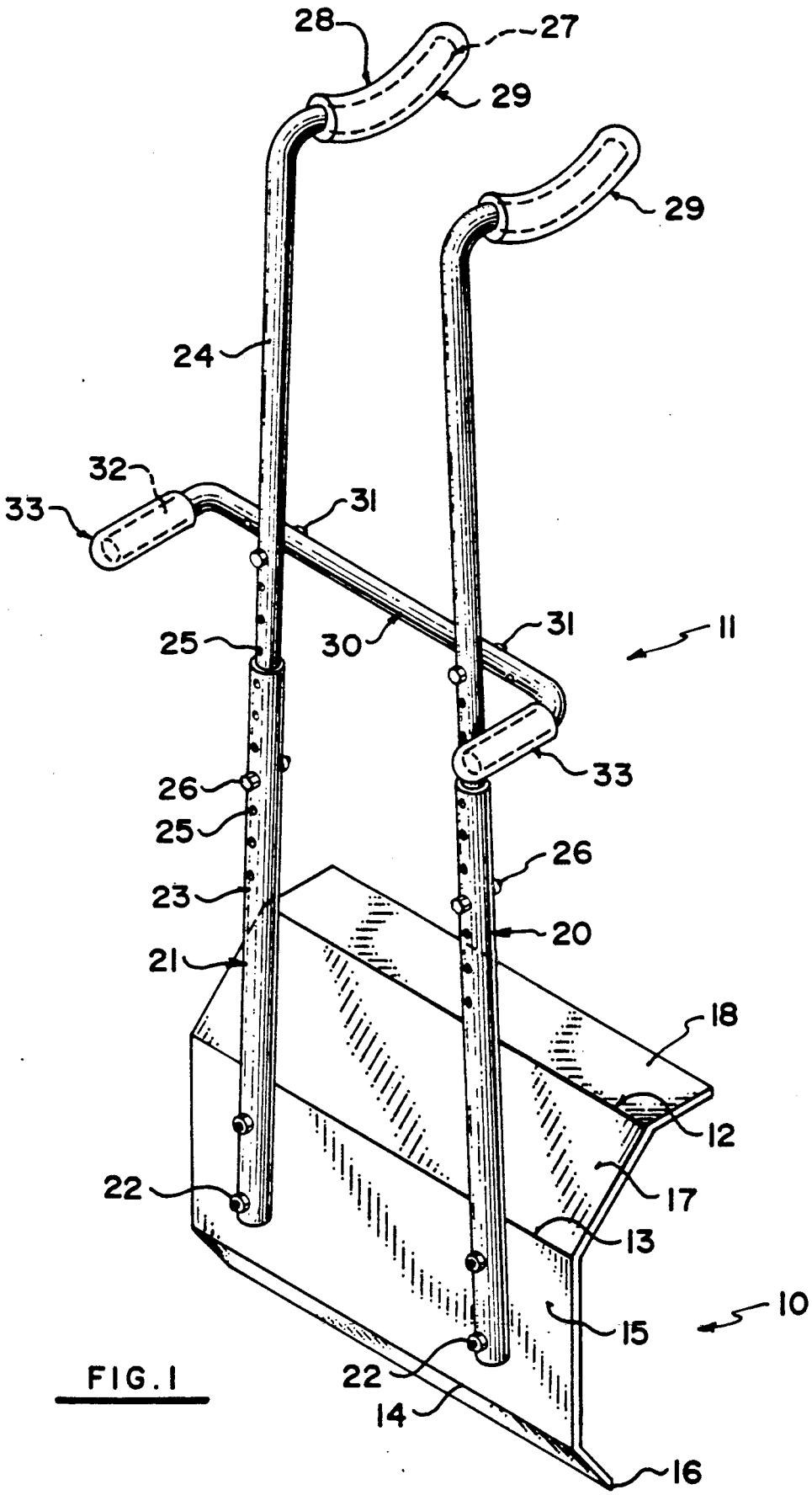
FIG. 1 is an isometric view of a snow shovel device according to the invention.

The snow shovel according to the invention comprises a blade portion indicated at 10 together with the handle assembly generally indicated at 11 for supporting and moving the blade in a scraping and pushing action.

The blade 10 is formed from a sheet of metal which has three transverse bend lines 12, 13 and 14. The three bend lines form four separate panels each of which is flat. A main base panel 15 is attached to the handle arrangement 11. A front edge panel 16 defines a front scraping edge along a forward edge of the base panel 15 for running across the ground in a scraping action. The edge panel 16 is only of narrow dimension and is sufficient merely to provide structural strength for the front edge of the base panel 15 to prevent its bending and warping in the scraping action. A rear retaining wall for pushing snow picked up by the scraping action of the front edge is defined by an inclined panel 17 and a rear panel 18 which are connected edge to edge to extend upwardly from the rear edge of the base panel 15. The blade arrangement 10 is therefore simply manufactured by bending action of a suitable material for example galvanized steel without the necessity for compound curvatures, welding or other forming actions.

The handle arrangement comprises a pair of elongate rails 20 and 21 each of which has a lower end attached to the under surface of the base panel 15 by suitable screw fasteners 22. Each of the rails comprises a lower tubular portion 23 and an upper tubular portion 24 of smaller diameter so it can slide within the lower tubular portion 23 as a sliding fit to provide adjustability of length of the respective one of the rails. Each of the tubular portions includes a plurality of holes 25 which pass transversely through the tubular portion so the holes can be aligned at a required length of the rail and fixed in position by a screw fastener 26.

Figure 2:
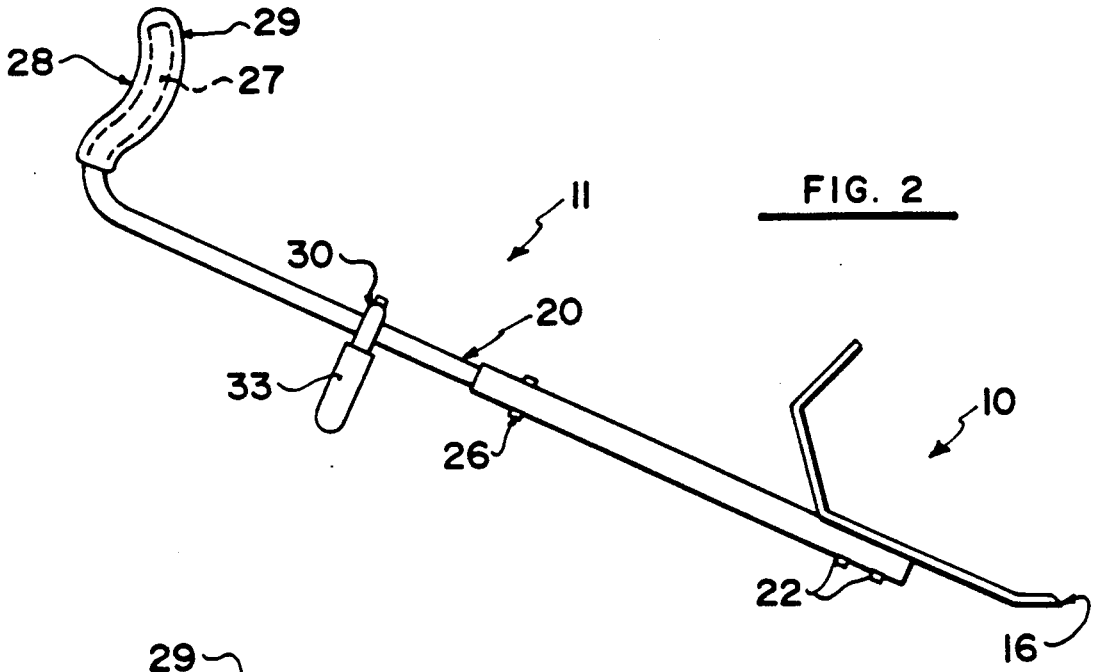
FIG. 2 is a side elevational view of the device of FIG. 1.
Figure 3:
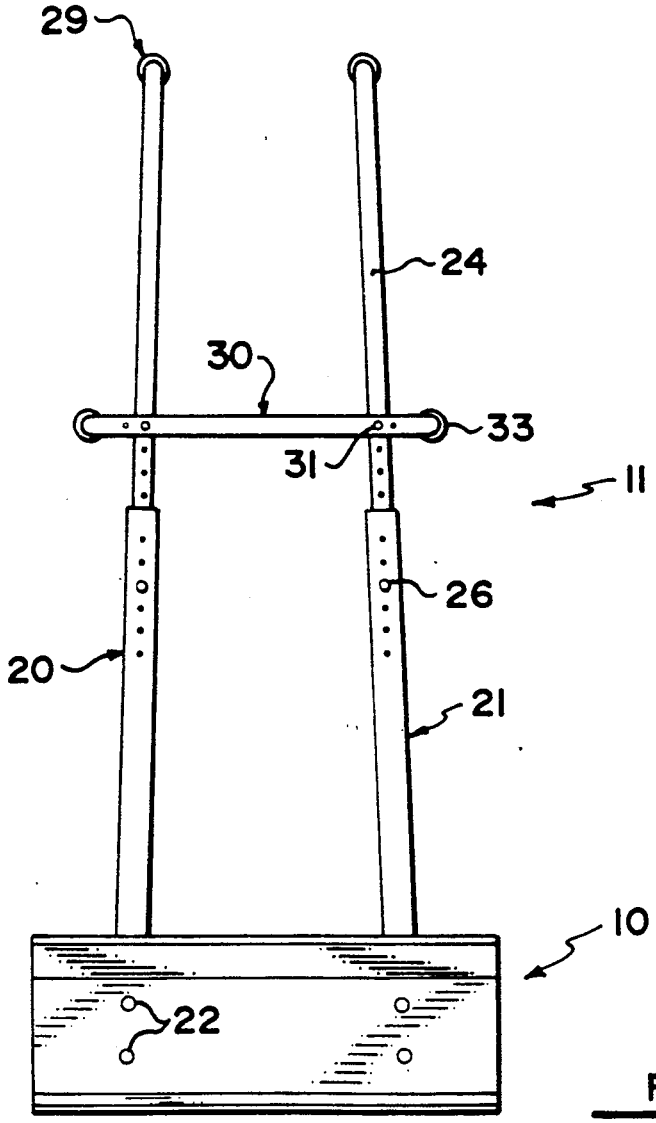
FIG. 3 is a top plan view of the device of FIG. 1.

An upper end of each of the rails 20 and 21 is bent as indicated at 27 to form a shoulder engaging portion. The bent portion is turned initially generally at right angles to the length of the rail and in a direction at right angles to the forward edge of the base panel 15 so that in use the portion 27 projects upwardly from the rail as best illustrated in FIG. 2. The portion 27 is also curved to define a concave recess on the side of the portion 27 remote from the blade. This recess 28 is suitably curved to receive the shoulder area of the user that is the area forwardly of and partly under the arm of the user in the manner of a crutch. The portion 27 is covered by a rubber padding 29 in the form of a sleeve which passes over the portion and is retained in place by its resilience relative to the curvature of the portion 27.

A crossbar 30 extends at right angles to the main rails 20 and 21 and is connected thereto by screw fasteners 31 which extend through one of a plurality of holes in the crossbar 30 and through one of the plurality of holes 25 in the rails 20 and 21. The crossbar 30 is formed from tubular material similar to the upper portions 24 and is bent at each end downwardly in a direction generally at right angles to the rails 20 and 21 and at right angles to the main transverse portion of the bar 30. The bent portions are indicated at 32 and each forms a hand grip on which is mounted a rubber hand grip sleeve indicated at 33.

The provision of adjustment holes in the crossbar 30 enables the spacing of the rails 20 and 21 at the crossbar to be adjusted thus adjusting the spacing of the shoulder receiving portions 27 to accommodate smaller or larger users.

The position of the crossbar 30 in a direction longitudinal to the rails 20 and 21 can also be adjusted by choosing particular ones of the holes 25 in either the upper tubular portion 24 or the lower tubular portion 23 as required. This adjustment can accommodate the difference in length of arm of the user. The previously described adjustment of the length of the rails 20 and 21 can accommodate the different height of the user from the scraping edge 16 on the ground to the position of the shoulder engaging portions 27.

In use, the user places the scraping edge 16 on the ground adjacent the snow to be shoveled and moved. The user then steps up to the rear of the device and places the curved portions 27 in the underarm area in contact with the shoulder at the forward part of the underarm area. The hands of the user can then reach forwardly and grasp the hand grip 33. In this manner force can be applied to the device in a pushing action both by the hands on the hand grip 33 and by the shoulders on the curved portions 27 and the movement can be controlled by the user's hands on the hand grip members. This forceful engagement of the device by the body of the user enables the user to apply vigorous action to the device in pushing the snow forwardly as it is scraped by the edge 16 and lifted onto the blade 10.

The additional force which the user can apply enables more snow to be pushed and enables the pushing action to require less muscular involvement by the user since the weight of the user can be advantageously employed in the pushing action.

If required where the snow is lighter or of little volume, the user can release the hand grips 33, lift the shoulders away from the portions 27 and stand back from the device merely pushing it lightly by grasping the portions 27 by hand.

Since various modifications can be made in my invention as hereinabove described, and many apparently widely different embodiments of same made within the spirit and scope of the Claims without departing from such spirit and scope, it is intended that all matter contained in the accompanying specification shall be interpreted as illustrative only and not in a limiting sense.

I claim:

1. A snow shovel comprising a blade including a blade edge arranged to scrape the ground and a blade surface to push snow lifted by the edge, and a handle arrangement by which the blade can be pushed across the ground, the handle arrangement comprising first and second elongate rails each connected at a forward end to the blade such that the edge intersects a longitudinal axis of each rail so that longitudinal force on the rail is applied through the edge to the ground, a pair of concave receiving portions each mounted on a respective one of the rails and defining a receptacle area which extends substantially at right angles to the blade edge and to the respective rail with the portions being spaced in a direction longitudinally of the edge each for engaging an area on the user adjacent the front of the underarm, said rails mounting the receiving portions on the blade such that the receiving portions are spaced from the blade by a distance such that the receiving portions lie substantially at shoulder height with the blade edge on the ground, each of the receiving portions being integrally formed with the respective one of the rails such that the rail is bent at an upper end thereof in a direction substantially at right angles to the length of the rail to form said receiving portion, a crossbar fixedly attached directly to each of the rails at a position thereon between the receiving portions and the blades so as to extend transversely thereacross from a first end adjacent one of the rials to a second end adjacent the other of the rails including means for adjusting the position of the rails thereon so as to adjust the spacing between the rails and a pair of hand grip members each formed at a respective end of the crossbar so as to extend downwardly therefrom substantially at right angles to the crossbar and at right angles to the respective rail, the hand grip members being fixed relative to the rails so that force applied to the hand grip members is directly communicated to the rails.

2. The invention according to claim 1 wherein each of the receiving portions projects upwardly from the respective rail.

3. The invention according to claim 1 wherein the length of each of the rails is adjustable.

4. The invention according to claim 1 wherein each of the rails comprises a pair of tubes with one tube being slideable inside the other tube and each tube having a plurality of transverse holes to that one tube can be clamped at a required position onto the other tube by a pin extending through aligned ones of the holes.

* * * * *